United States Patent [19]

Suzuki

[11] Patent Number: 4,673,281

[45] Date of Patent: Jun. 16, 1987

[54] IMAGE FORMING APPARATUS

[75] Inventor: Akira Suzuki, Kawasaki, Japan

[73] Assignee: Canon Kabushiki Kaisha, Tokyo, Japan

[21] Appl. No.: 828,062

[22] Filed: Feb. 10, 1986

Related U.S. Application Data

[63] Continuation of Ser. No. 451,261, Dec. 20, 1982, abandoned.

[30] Foreign Application Priority Data

Dec. 29, 1981 [JP] Japan ..... 56-215325

[51] Int. Cl.[4] ..... G03G 15/00

[52] U.S. Cl. ..... 355/14 R; 355/14 C

[58] Field of Search ..... 355/14 R, 14 C, 3 R, 355/14 CH, 3 CH, 55, 56

[56] References Cited

U.S. PATENT DOCUMENTS

| | | | |
|---|---|---|---|
| 4,133,477 | 1/1979 | Marino et al. | 355/14 R X |
| 4,186,299 | 1/1980 | Batchelor | 355/14 R X |
| 4,196,476 | 4/1980 | Steiner | 355/14 R X |

*Primary Examiner*—A. C. Prescott

*Attorney, Agent, or Firm*—Fitzpatrick, Cella, Harper & Scinto

[57] ABSTRACT

A copying machine has a memory for registering copying information. One registration of a plurality of registered copying information is read out and a copying operation is executed in accordance with the copying information. The copying information registered in the memory is updatable.

7 Claims, 8 Drawing Figures

IMAGE FORMING APPARATUS

This is a continuation of application Ser. No. 451,261 filed Dec. 20, 1982 now abandoned.

BACKGROUND OF THE INVENTION

1. Field of the Invention

The present invention relates to an image forming apparatus which permits preregistration of data.

1. Description of the Prior Art

In a prior art image forming apparatus such as a copying machine, an operator must enter and check the number of copies, density of copies, a copy size and a selection of sorter trays prior to each copying operation.

In routine jobs, predetermined input settings are repeated. Nevertheless, the entry operation described above is required for each copying operation. It has been troublesome to the operator.

A copying machine which stores copying information for a plurality of copying operations so that the plurality of copying operations are carried out without intervention of the operator has been proposed. However, the plurality of copying operations cannot be arbitrarily selected and the operations cannot be carried out by a simple manipulation. In addition, since the copying machine is complex, a long time is required to locate and repair a fault or a malfunction,

SUMMARY OF THE INVENTION

It is an object of the present invention to provide an image forming apparatus capable of registering a plurality of image forming information, reading out the information and updating the information as required.

It is another object of the present invention to provide an image forming apparatus capable of registering diagnosis information for the image formation and updating the information as required.

It is another object of the present invention to provide an image forming apparatus capable of registering account information for the image formation and updating the information as required.

It is a further object of the present invention to provide an image forming apparatus capable of repeatedly registering operation information for the image formation and reading out the information as required.

It is a still further object of the present invention to provide an improved copying machine which reduces input operations necessary for copying.

It is a further object of the present invention to provide an image forming apparatus having improved functions of registering, reading and updating control information.

The above and other objects of the present invention will be apparent from the following description of the preferred embodiments of the present invention.

DETAILED DESCRIPTION OF THE PREFERRED EMBODIMENTS

Figure 1:
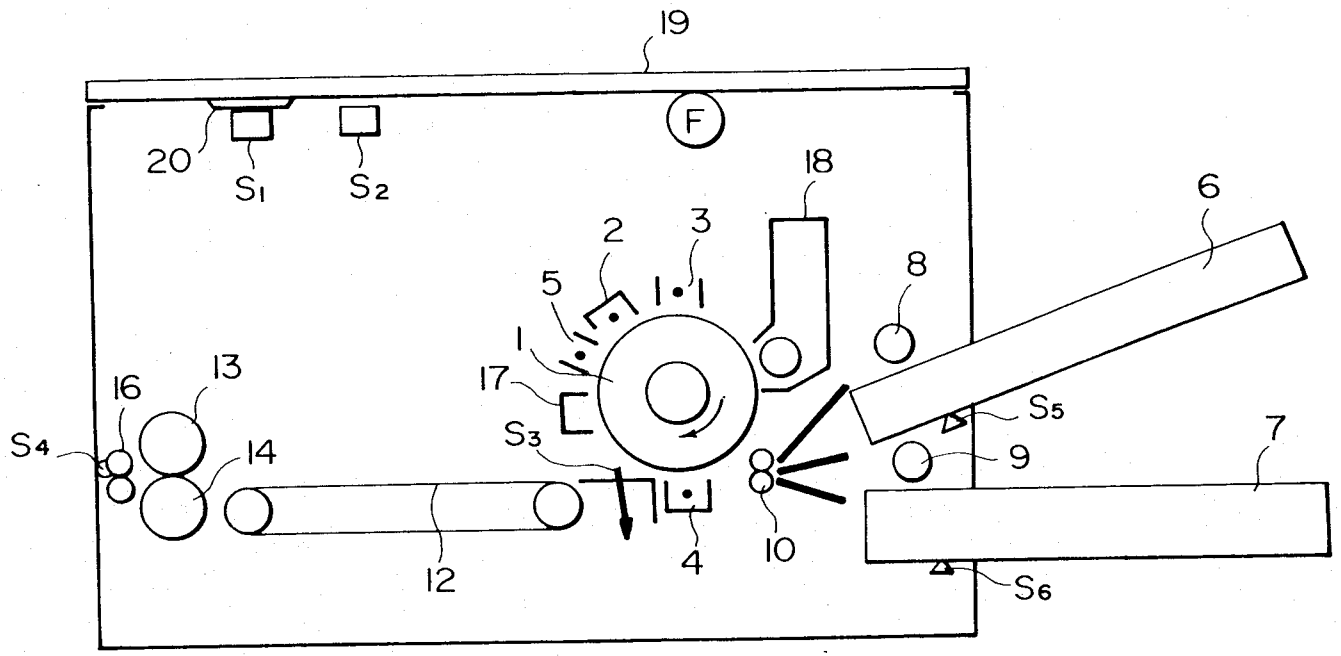
FIG. 1 shows a sectional view of a copying machine in accordance with one embodiment of the present invention.

FIG. 1 shows one embodiment of the copying machine of the present invention.

A photosensitive drum 1, and a primary charger 2, a secondary charger 3, a transfer charger 4 and a discharger 5 which are necessary to form and transfer a latent image, are provided. Numerals 6 and 7 denote upper and lower cassettes, numerals 8 and 9 denote upper and lower pickup rollers, numeral 10 denotes a registration roller, S3 denotes a conveyer or misseparated paper jam detector, numeral 12 denotes a conveyer belt, numerals 13 and 14 denote upper and lower fixing rolls, S4 denotes a fixing ejected paper jam detector, numeral 16 denotes an ejection roller, numeral 17 denotes a cleaner, numeral 18 denotes a developer, numeral 19 denotes an original mount which is reciprocated to light-scan an original, and S1 and S2 denote a switch to detect a stop position of the original mount 19 and a switch to energize the registration roller 10 which is actuated by a cam 20. When a copy button is depressed, a main motor is energized to rotate the drum 1, the rollers 13, 14 and 16 and the belt 12 so that the original mount 19 is advanced to start the image exposure and a latent image is formed on the charged drum 1 and the image is developed. The developed image is transferred onto a paper fed from the cassette 6 or 7 by the roller 8 or 9 and the paper is conveyed to the fixing rollers 13 and 14 where the image is fixed. The paper is then ejected. S3 and S4 denote the switches which are actuated by the paper to detect a paper jam. S5 and S6 denote switches for detecting sizes of the cassettes 6 and 7. A paper is fed from the cassette of a desired size under control of a size input signal (registered signal) from a keyboard 401 shown in FIG. 2. A density of copy is controlled by varying a light intensity of a lamp under control of an input signal (registered signal) from a keyboard 402.

Figure 2:
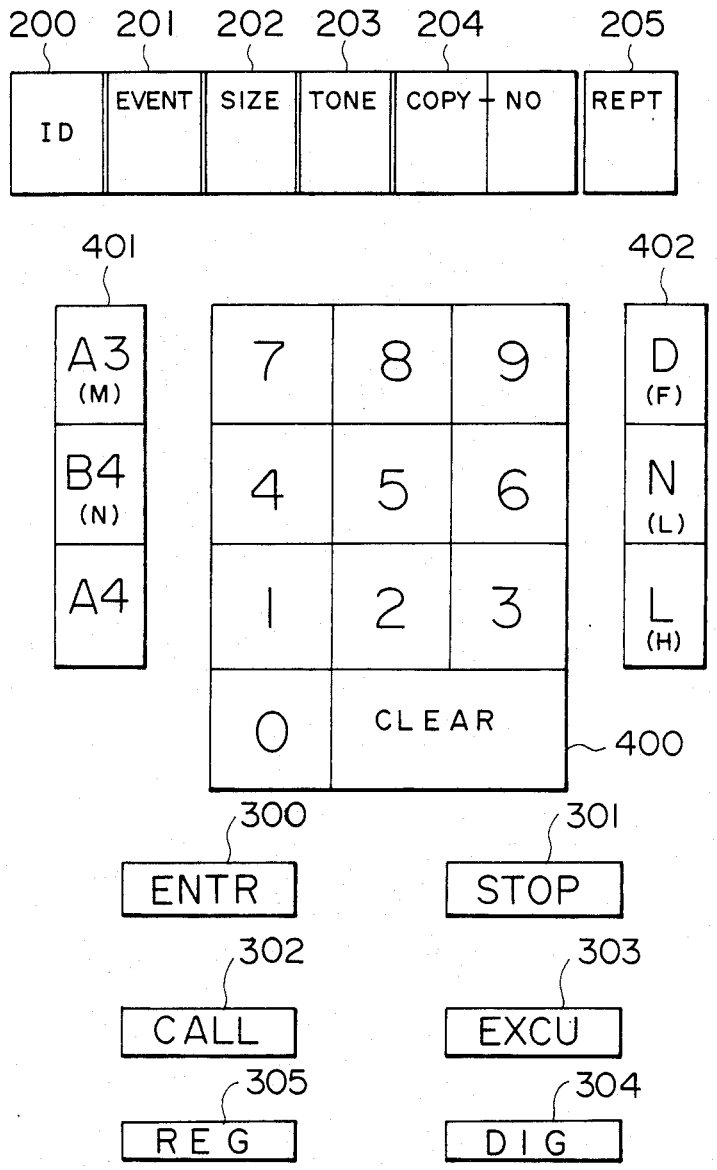
FIG. 2 shows a plan view of a console of the copying machine of FIG. 1.

FIG. 2 shows a plan view of a console of the copying machine of FIG. 1. Numeral 200 denotes a one-digit display for displaying a registration number which is related to a plurality of group information (file) for a group (event) including the size, tone and the number of copies. Numeral 201 denotes a one-digit display for displaying the number of registered events, numeral 202 denotes a display for displaying a copy size, which, for example, displays one of cassette sizes A4, B4 and A3, numeral 203 denotes a display for displaying copy tone, which displays one of D, N and L, numeral 204 denotes a two-digit display for displaying the number of continuous copies, and numeral 205 denotes a one-digit display for displaying the number of times of repetition of the registration 1 event. Numeral 400 denotes a ten-key for entering the number of copies, the registration number and the number of times of repetition of the event and a clear key for correcting (cancelling) the entry by the ten-key and correcting (cancelling) the displays 200–205, numeral 401 denotes size selection keys, numeral 402 denotes copy tone selection keys, numeral 300 denotes an entry key for commanding the registration and the updating of the information entered by the above keys, numeral 301 denotes a stop key for commanding the stop of the registered copying operation, numeral 302 denotes a call key for commanding the display of the information corresponding to the registration number on the displays 200–205, numeral 303 denotes an execution key for commanding the start of the registered copying operation, numeral 304 denotes a diagnosis key for commanding the registration and the execution of an error diagnosis routine for copying elements (such as motor), and numeral 305 denotes a registration key for commanding the registration and the execution of a routine to read out an accumulated number of copies by copy size.

Figure 3:
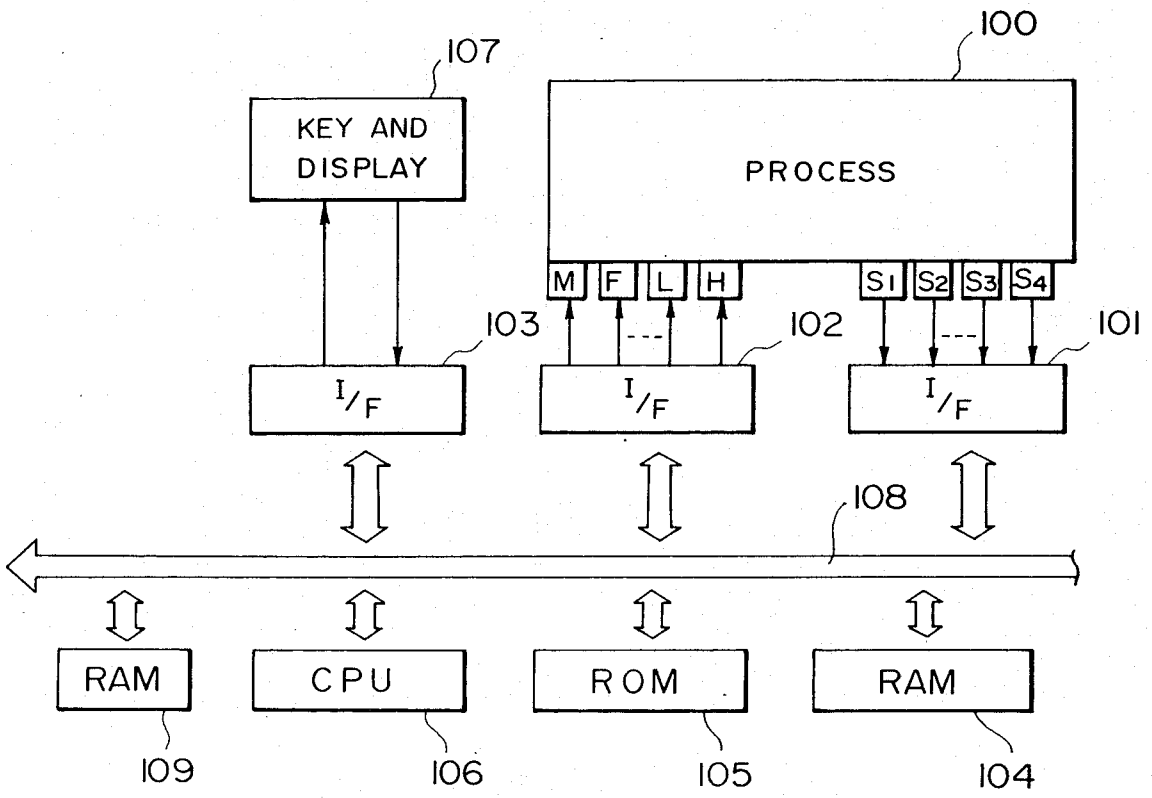
FIG. 3 shows a control circuit diagram of the copying machine of FIG. 1.

FIG. 3 shows a control unit of the copying machine of the present invention. Numeral 100 denotes a process load for the elements shown in FIG. 1, M denotes a main motor, F denotes a paper feed and registration clutch, L denotes an original mount forward clutch and H denotes a heater. A CPU 106 controls the overall system in accordance with a content of a program memory ROM 105 which is connected to the CPU 106 through a bus 108. Numeral 104 denotes a working memory RAM for the CPU control and numeral 109 denotes a non-volatile memory RAM for storing registration procedure information. A volatile memory RAM may be used as a backup to take the place of the non-volatile memory RAM. Alternatively, an EE-P-PROM which is an electrically erasable P-ROM or an ultra-violet erasable P-ROM may be used.

A key/display unit 107 includes the keys and the displays shown in FIG. 2 and it is controlled by the CPU 106 through an interface 103. Interfaces 102 and 103 receive inputs from the process 100, for example from the switch S1 of FIG. 1 and supply outputs to the process 100, for example to the motor M under control of the CPU 106. The CPU 106 is a well-known microcomputer which is system-configured. The ROM 105 stores programs shown by flow charts of FIGS. 4–5 and the CPU 106 executes the registration of the information, the registered copying operation, the diagnosis operation and the accounting operation under control of the programs. For example, it carries out a sequence control for the process loads M, F, L and H of FIG. 3, a selection control for the pickup rollers 8 and 9 of FIG. 1, a copying operation by the light intensity control of the lamp (not shown), a diagnosis operation by the selection control of M, F, L and H, and a read/display operation of the total number of copies by copy size, the total number of times of jam by location and cost of consuming material used, which are stored in the non-volatile memory RAM 109.

Figure 4:
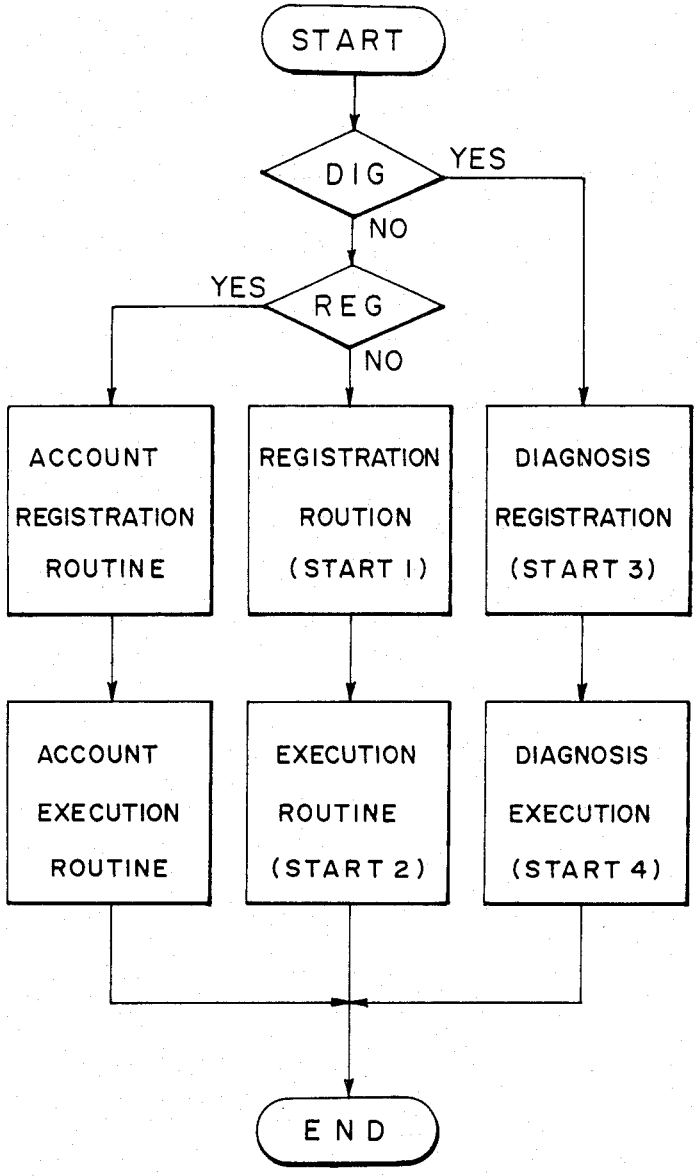
FIG. 4 shows a registration/execution control flow chart, FIGS. 5 and 6 detailed flow charts of FIG. 4, and FIGS. 7 and 8 show tables of a non-volatile memory (RAM) 109 of FIG. 2.

FIG. 4 shows a control flow chart. When the DIG key 304 and the REG key 305 of FIG. 2 are not depressed and the clear key is depressed, diagnosis mode and account mode routines are not executed and a copy mode routine is executed. The copy mode routine includes a copying information registration routine (START 1) of FIG. 5 and a copy execution routine (START 2) of FIG. 6. The diagnosis mode routine includes a diagnosis information registration routine similar to FIG. 5 and a diagnosis execution routine similar to FIG. 5. The account mode routine includes similar routines.

Figure 5:
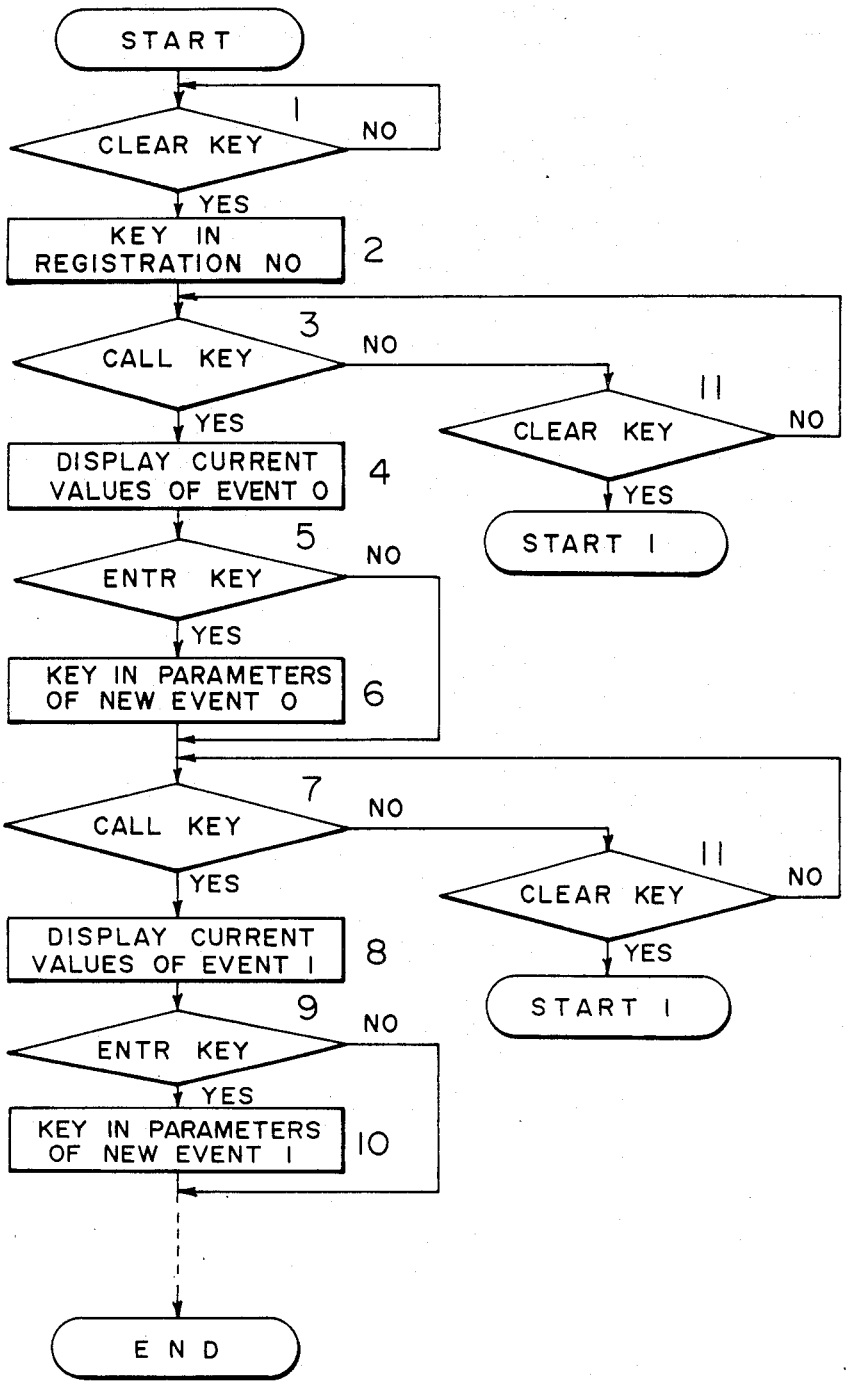

Referring to FIG. 5, the registration of the copying information, the configuration of the registered information and the updating of the information are explained.

When the clear key 400 of FIG. 2 is depressed, a display area of the working RAM 104 of FIG. 3 is cleared so that all of the displays 200–205 are reset to zero (step 1).

Figure 7:
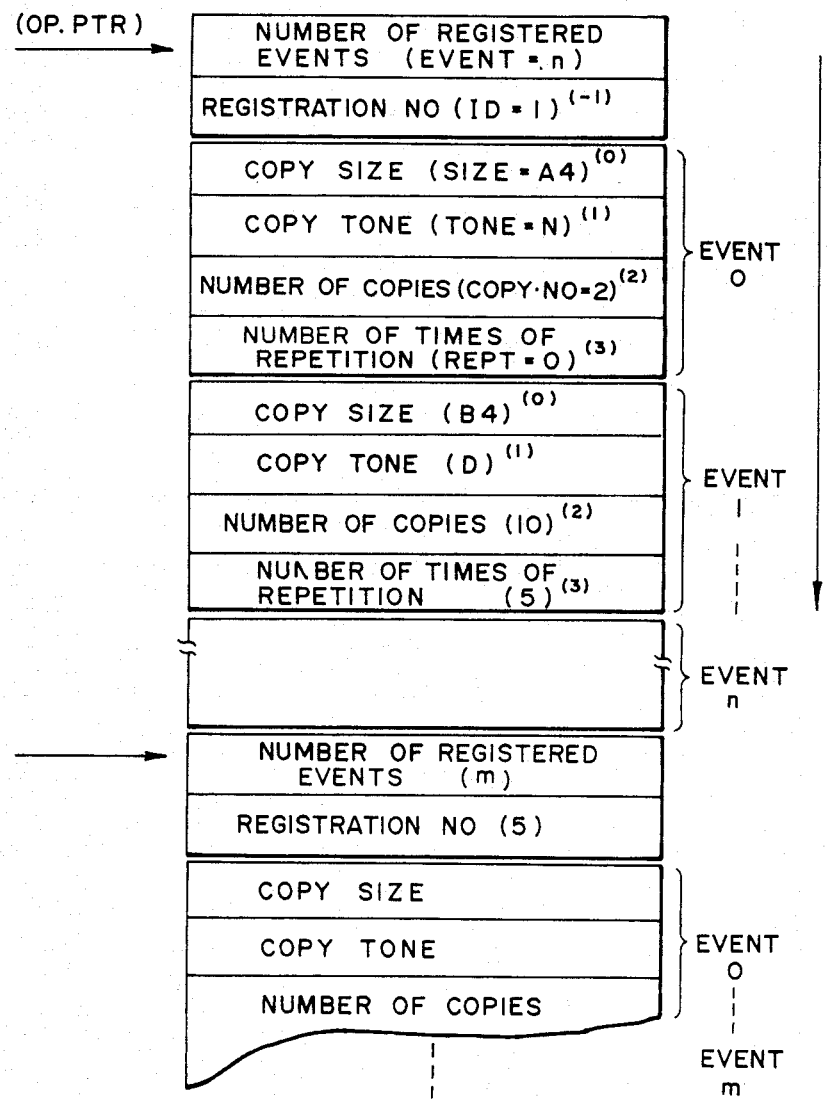

The non-volatile memory RAM 109 has a table area for storing the copying information corresponding to the displays 200–205 as shown in FIG. 7. For example, the registration number is 1 and the number of events is n. For the first event 0, the copy size A4, the copy tone N, the number of continuous copies 2 and the number of times of restart after pause 0 are registered. For the next event 1, B4, D, 10 and 5 are registered respectively. In this manner, the information for n events is registered. For the registration number K, the number of events and the copying information for the respective events are similarly stored.

When a key, for example key (1), of the ten-key 400 of FIG. 2 is depressed after the clear key has been depressed in the step 1 of FIG. 5, the CPU 106 in FIG. 3 detects it (step 2). When the call key 302 is then depressed (step 3), current values of the event of the registered information of FIG. 7 corresponding to the registration number 1 are displayed on the displays 200–205 of FIG. 2 (step 4). If updating is required, the entry key 300 of FIG. 2 is depressed (step 5) and the information keys 400, 401 and 402 of FIG. 2 are actuated in the order of 400, 401, 402, 400, 400 so that new parameters of number of events, size, tone, number of copies and number of times of repetition are stored in the non-volatile memory RAM 109 of FIG. 3 as the information for the registration number 1 (step 6). Then the call key 302 of FIG. 2 is depressed (step 7) to display the current values of the event 1 stored in the RAM 109 (step 8). In the event 0, if updating is not required, the entry key 300 of FIG. 2 is not depressed and the call key 302 is depressed so that the current values of the event 0 indicate the content of the event 1. The parameter of the event 1 can be updated in a similar manner. The parameters of the events 2–n can be displayed and updated in a similar manner. It may be possible to execute the operation with the updated parameters but the updated parameters are not registered and the parameters before the updating are registered. This is also true for the account operation.

For another registration number, the clear key 400 of FIG. 2 is depressed so that the process jumps to the initial routine START 1 (step 11) and the other registration number is designated by the ten-key 400 of FIG. 2. In this manner, the information of the other registration number is displayed and updated in a similar manner. When all of the registration numbers have been confirmed or the stop key 301 of FIG. 2 is depressed, the process goes to an end step, hence to the copy execution routine of FIG. 6.

Figure 6:
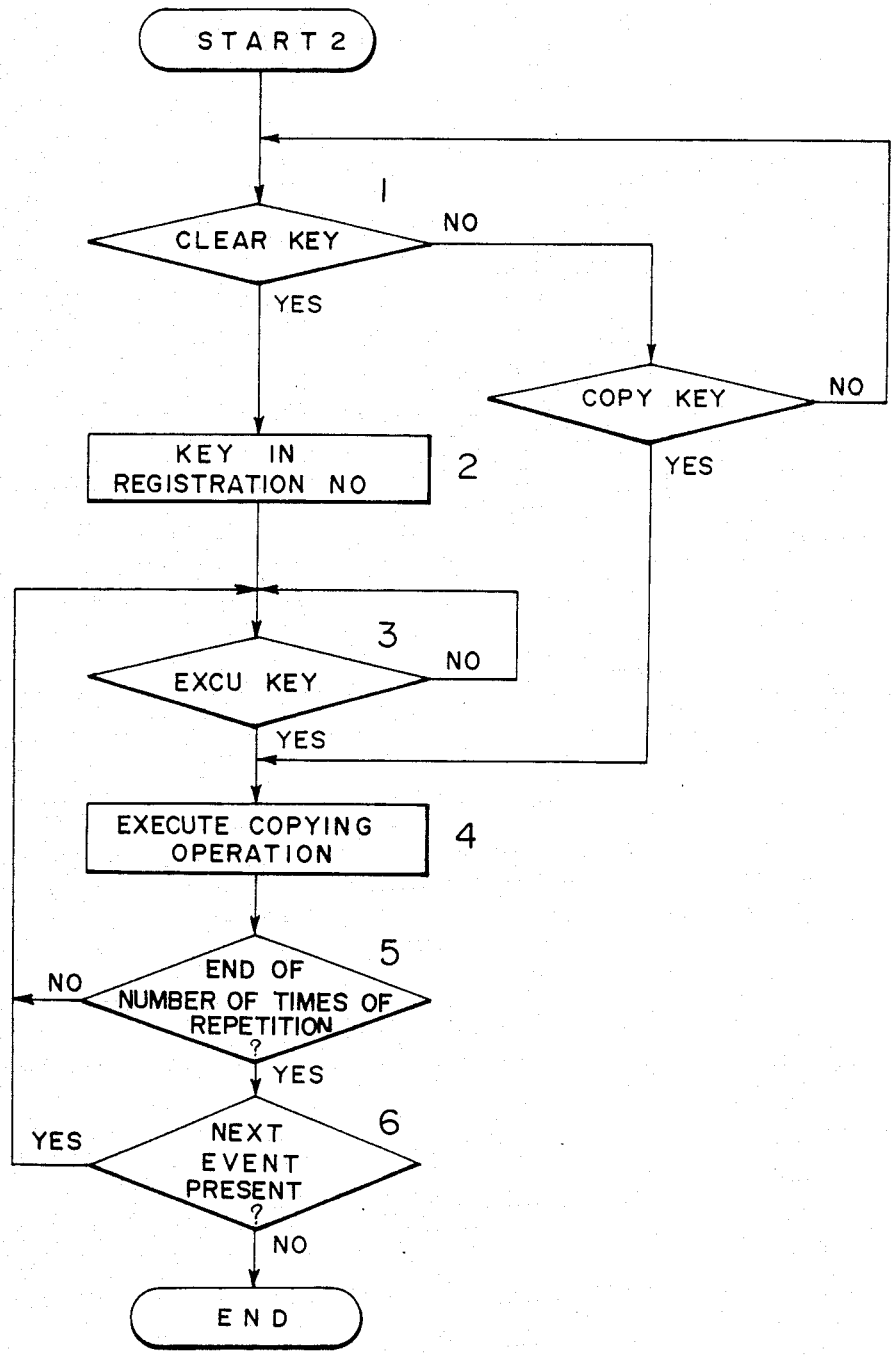

FIG. 6 shows the routine for reading out the registered file of the non-volatile memory RAM 109 of FIG. 3 and executing the copying operation in accordance with the parameters of the events.

When the clear key 400 of FIG. 2 is depressed, the diplays are cleared (step 1) and the registration number read routine is started. When a key, for example key (1), of the ten-key 400 of FIG. 2 is depressed, "1" is displayed on the display 200 and the parameters of the event are displayed on the displays 201–205 (step 2). When the execution key 303 of FIG. 2 is depressed, the copying operation is started in accordance with the parameter data of the event 0 stored in the non-volatile memory RAM 109 of FIG. 3 (step 3). After the sequence of copying operations, the machine is paused. Since the registered number of times of repetition is zero (step 5), the process goes to the execution routine for the next event 1. If the event 1 is not present (step 6), it is determined that the registered copying operations have been completed and a power supply of the copying machine is turned off as required. The present case corresponds to a normal copy mode. When the events 1–n are present, the process again goes to the copy execution routine by the execution key 303 of FIG. 2 and the parameters of the event 1 are read and the copying operation is continued in accordance with those parameters. When the parameters of the event n have been read and the copying operation therefor has been completed, the registration operation is completed. The completion of the events is determined by the CPU in the step 6 by setting a blank area for the last event in the non-volatile memory RAM 109 of FIG. 3. In the step 5, if the content of the repeat area of the non-volatile memory RAM 109 of FIG. 3 is not zero, the execution key 303 of FIG. 2 is depressed and the continuous copying operation is repeated in accordance with the parameters of the same event. After the copying operation has been repeated by the number of times of repetition, the process goes to the next step. The repetition feature provides an advantage when an automatic original exchange device for the original on the original mount 19 of FIG. 1 is provided. When the first copying operation for the event 0 is completed, a belt is driven to automatically eject an original and another original is loaded on the original mount 19. When an original sensor on the original mount 19 senses the loading of the original, it produces a signal which is used in place of the signal from the execution key to resume the execution of the copying operation of the event 0.

When the parameters are inputted before the clear key 400 of FIG. 2 is depressed, and the copy key (not shown) is depressed, a conventional copying operation is executed.

The copying operation of the step 4 is executed in accordance with the data stored in the working memory RAM 104 of FIG. 3. The registered parameters for the respective events in the nonvolatile memory RAM 109 are transferred to the working memory RAM 104 prior to the event operation.

Based on the data stored in the working memory RAM 104, the upper or lower paper feed roller is selected, the lamp light intensity is determined, the number of times of reciprocation of the original mount is determined and the copying operation is executed in a well-known sequence.

After the completion of the registered copying operation and before the power supply is turned off, the clear key 400 of FIG. 2 is depressed (step 1) and the other registration number is entered by the ten-key 400 (step 2) and the parameters of that registration number are read out so that the copying operation for the other registration number is executed.

Those registered parameters can be read out any time unless they are updated, even if the power supply of the copying machine is turned off (the power supplies of the displays and the CPU are turned off), because the memory is non-volatile. Accordingly, the copying operation can be simplified.

Figure 8:
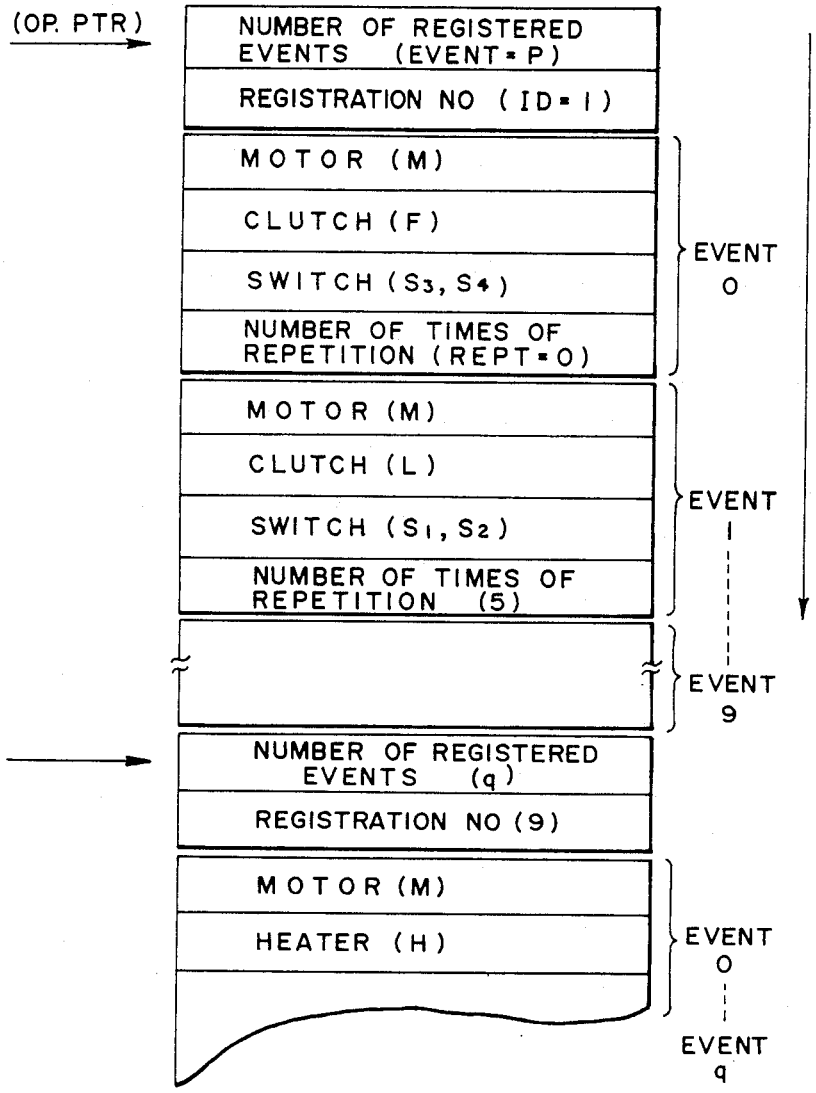

FIG. 8 shows another table area of the nonvolatile memory RAM 109 of FIG. 3 corresponding to the displays 200–205 of FIG. 2. It stores parameters for the registered information on the process diagnosis. It is accessed by depressing the diagnosis key of FIG. 2. In the access routine, the parameters in the flow of FIGS. 5 and 6 are substituted by FIG. 8 to form the routines START 3 and START 4.

When the diagnosis key is depressed, the clear key is depressed and then a key, for example key (1), of the ten-key is depressed, the parameters M and F for the event 0 are displayed by the size and tone displays 202 and 203 of FIG. 2, and "3, 4" is displayed by the number of copy display 204 of FIG. 2. Thus, the main motor M is selected out of the motors, the paper feed roller clutch F is selected out of the clutches and the jam sensor switches S3 and S4 are selected out of the switches so that the normalities of the loads and the sensing elements are checked. In the diagnosis event 0, the roller is coupled to the main motor M by the clutch F to feed and eject one paper. Since a high voltage corona charger and a developing unit are not energized, the conveying system can be diagnosed without loss of toner and with less danger. Thus, the roller can be observed with a door being open and the jam condition can be checked. The switches S3 and S4 can be checked by hand to cause jam display. In the event 1, a clutch L for the original mount and a switch acting as a position sensor for the original mount are checked. As in the event 0, the check and the display are carried out without energizing other elements. The keys of FIG. 2 are used for those parameters. The A3 size key is used as a motor selection key, the tone D and N keys are used as F and L keys and (1)–(4) keys are used as S1–S4 keys.

The registration, updating and configuration of the parameters are executed in the same manner as FIG. 5. The number of times of repetition corresponds to the number of times of repetition for the same diagnosis event.

The registration diagnosis is executed in a similar manner as FIG. 6.

Thus, desired process locations can be sequentially diagnosed by simply entering the registration numbers of diagnosis by the ten-key 400 of FIG. 2. The registered contents of the diagnosis parameters can be changed depending on the location of the installation of the copying machine and the application thereof so that the diagnosis operation is highly facilitated. It is much superior to the system in which the diagnosis is executed by specifying the object to be diagnosed and the location to be diagnosed for each case. It may be possible to record the parameters on a magnetic tape or cards and read out the parameters therefrom and store them in the non-volatile memory RAM 109. As in the image forming operation, a group diagnosis operation mode and an individual diagnosis operation mode can be selectively executed. When the parameter key is depressed before the key for executing the registration operation is depressed, the latter mode is selected. The same is true for the account operation.

What I claim is:

1. An image forming apparatus comprising:

means for registering a plurality of groups of image forming information data, wherein each group includes a plurality of selected image forming parameters;

image forming information entry means for entering said plurality of groups of said selected data to be registered by said registering means;

means for selecting and reading said groups of data;

means for changing the image forming information registered in said registering means; and means for executing an image forming operation in accordance with a selected said group of image forming information data registered in said registering means as changed by said changing means.

2. An image forming apparatus according to claim 1, wherein one of said registered image forming parameters is copy size.

3. An image forming apparatus according to claim 1, further comprising means for displaying said image forming information read by said reading means.

4. An image forming apparatus according to claim 1, wherein said reading means can read a plurality of said registered groups of data in sequence.

5. An image forming apparatus according to claim 1, further comprising means for coupling said changing means to seid entry means wherein said changes are made by actuating said entry means.

6. An image forming apparatus comprising:

means for registering image forming parameters input by operator, wherein said registering means registers a plurality of groups of image forming operation data, and wherein each said group includes a plurality of said parameters;

means for selecting and reading the groups of register image forming data;

means for changing the registered image forming data registered in said registering means; and means for selecting and executing an image forming operation in accordance with a selected group of the registered image forming data as changed by said changing means.

7. An image forming apparatus according to claim 4, further comprising means for displaying the image forming parameters read by said reading means.

* * * * *

UNITED STATES PATENT AND TRADEMARK OFFICE

CERTIFICATE OF CORRECTION

PATENT NO. : 4,673,281

DATED : June 16, 1987

INVENTOR(S) : AKIRA SUZUKI

It is certified that error appears in the above-identified patent and that said Letters Patent is hereby corrected as shown below:

IN THE DRAWING FIGURES - SHEET 4 OF 8

FIGURE 4, "ROUTION" should read --ROUTINE--.

COLUMN 2

Line 1, "6 detailed" should read --6 show detailed--.

COLUMN 3

Line 25, "PROM" should read --ROM--.

COLUMN 6

Line 40, "highly" should read --greatly--.

COLUMN 7

Line 12, "seid" should read --said--.
Line 16, "by operator" should read --by an operator--.

UNITED STATES PATENT AND TRADEMARK OFFICE

CERTIFICATE OF CORRECTION

PATENT NO. : 4,673,281

DATED : June 16, 1987

INVENTOR(S) : AKIRA SUZUKI

It is certified that error appears in the above-identified patent and that said Letters Patent is hereby corrected as shown below:

COLUMN 8

Line 4, "register" should read --registered--.
Line 12, "claim 4," should read --claim 6,--.

Signed and Sealed this

Seventeenth Day of November, 1987

*Attest:*

DONALD J. QUIGG

*Attesting Officer*

*Commissioner of Patents and Trademarks*